US005427438A

United States Patent [19]

Fochs

[11] Patent Number: 5,427,438

[45] Date of Patent: Jun. 27, 1995

[54] RESTRAINT FREE AMBULATION DEVICE

[75] Inventor: Arthur J. Fochs, Appleton, Wis.

[73] Assignee: Innovative Products Unlimited, Inc., Appleton, Wis.

[21] Appl. No.: 176,943

[22] Filed: Jan. 3, 1994

Related U.S. Application Data

[63] Continuation-in-part of Ser. No. 59,827, May 7, 1993.

[51] Int. Cl.[6] ..... A61H 3/04

[52] U.S. Cl. ..... 297/467; 297/5; 297/344.18; 297/DIG. 4; 135/67

[58] Field of Search ..... 297/467, 5, 344.12, 297/344.18, 6, 440.24, 115, DIG. 4; 280/87.021; 135/67, 66, 65, 74

[56] References Cited

U.S. PATENT DOCUMENTS

| | | | |
|---|---|---|---|
| 2,459,066 | 1/1949 | Duke | 297/5 |
| 2,981,312 | 4/1961 | Sundberg | 297/5 |
| 3,695,702 | 10/1972 | Ingellis | 297/441 |
| 4,342,465 | 8/1982 | Stillings | 280/87.02 |
| 4,621,804 | 11/1986 | Mueller | 272/70.3 |
| 4,759,562 | 7/1988 | Vinyard et al. | 280/289 |
| 4,770,410 | 9/1988 | Brown | 272/70.3 |
| 4,953,851 | 9/1990 | Sherlock et al. | 272/70.3 |
| 5,058,912 | 10/1991 | Harroun | 280/87.021 |
| 5,083,806 | 1/1992 | Brown | 280/87.05 |

*Primary Examiner*—Laurie K. Cranmer
*Attorney, Agent, or Firm*—Basile and Hanlon

[57] ABSTRACT

A combination chair and walker comprises a primary frame and a bottom frame. The primary frame having laterally spaced apart primary front and rear legs spaced rearwardly thereof. The primary frame releasably attached to the bottom frame. The bottom frame comprising an auxiliary frame extending laterally from the primary front and rear legs. The auxiliary frame has auxiliary front and auxiliary rear legs. The primary front and auxiliary rear legs provide for movement over a floor in a stable, upright configuration. The auxiliary front legs extend close to the floor to provide added stability to prevent a person from tipping the chair/-walker.

11 Claims, 2 Drawing Sheets

RESTRAINT FREE AMBULATION DEVICE

BACKGROUND OF THE INVENTION

This application is a continuation-in-part of U.S. Ser. No. 08/059,827 filed on May 7, 1993 which is currently pending before the United States Patent and Trademark Office.

The present invention relates generally to ambulation devices, and more particularly to such a device which is virtually restraint free and aids in both walking and sitting of elderly and disabled persons.

Chair/walkers have been proposed which afford relatively easy ingress and egress and which provide a surrounding or enclosing safety frame system for minimizing the chances of a user falling or sliding and/or slipping off the seat to the floor. However, these chairs have not provided for any substantial chair height adjustment. As such, the chair height may be too low to be comfortable for sitting. Further, a stationary chair height may not allow use of a single chair by more than one person due to height and/or size differential. The known chair/walkers also generally do not provide for movable seats, whereby the seat may be moved rearward for ease while walking. Still further, current chair/walkers generally do not provide sufficient lateral stability to prevent a person and the chair from tipping over.

Thus, it is an object of the present invention to provide such a stable chair/walker having adjustable chair height. It is a further object of the present invention to provide such a chair/walker which optionally has a movable seat for further comfort.

SUMMARY OF THE INVENTION

The present invention addresses and solves the problems enumerated above. The present invention comprises a combination chair and walker for aiding the independent mobility of elderly or disabled persons in standing, walking and sitting. The chair/walker comprises an adjustable primary frame having laterally spaced apart primary front legs and primary rear legs spaced rearwardly of the primary front legs, a bottom frame located proximate to a floor comprising adjustable attachment means to the primary front and primary rear legs and having an auxiliary frame extending laterally from the primary front and primary rear legs and rearwardly of the primary rear legs.

The auxiliary frame having laterally spaced apart auxiliary front legs and auxiliary rear legs spaced rearwardly of the auxiliary rear legs, the primary front legs and the auxiliary rear legs supporting the chair/walker for movement over the floor in a stable, upright configuration. The auxiliary front legs extend close to the floor to prevent a person from tipping the chair/walker.

Means for sitting are provided, the sitting means being supported from the primary frame at a predetermined sitting position, the sitting means having a forward edge spaced rearwardly of the primary front legs and defining an open space extending rearwardly of the primary front legs for accommodating a person's legs while in a standing, walking and sitting position. Means, disposed at a rearward portion of the primary frame, support a person's back area. Means to adjustably attach the primary frame to the bottom frame to selectively position the height of the primary frame and sitting means in relation to the floor. Means on the primary frame to support at least one of a person's side and arms.

A frontal crossbar, attached to, and extending laterally between the side and arm support means, supports at least one of a person's front side and arms and guides the chair/walker, the crossbar having one end portion pivotally connected to one side of the side and arm support means for pivotal movement toward an open position extending upwardly when an opposite end portion of the crossbar is disconnected from an opposite side of the side and arm support means, to permit ingress and egress of the person from a front side of the chair/walker. A crotch strap is attached to the primary frame and extends between a person's legs into the open space, the strap being releasably attachable to the frontal crossbar while in a closed position. Means, cooperable with the opposite side of the side and arm support means, lock the crossbar against unwanted pivotal and vertical movement while in the closed position and provide a firm hand rail for guiding the chair/walker when secured to extend between the side and arm support means.

BRIEF DESCRIPTION OF THE DRAWINGS

Other objects, features and advantages of the present invention will become apparent by reference to the following detailed description and drawings, in which.

DESCRIPTION OF THE PREFERRED EMBODIMENT

Figure 1:
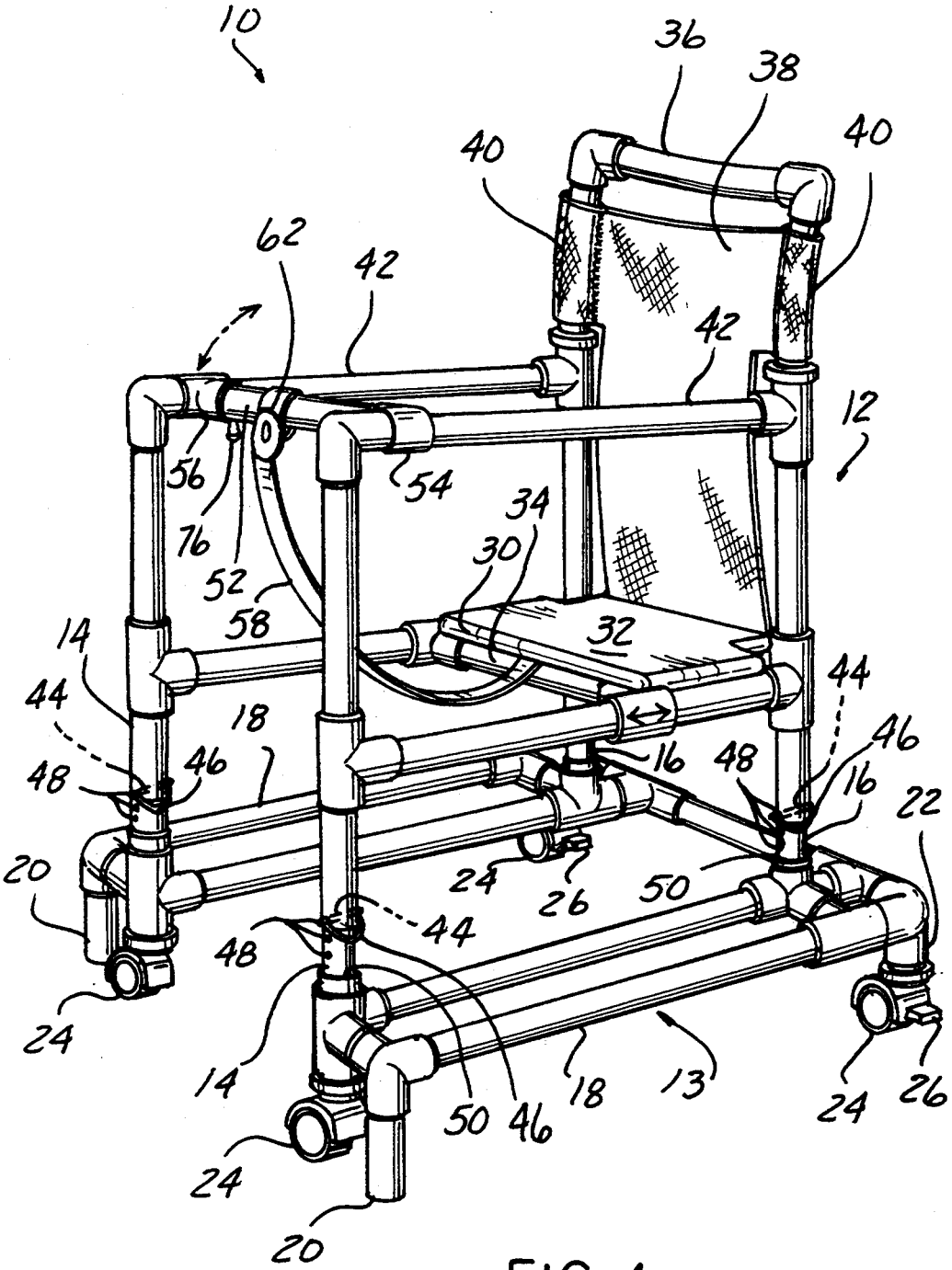
FIG. 1 is a perspective view of the chair/walker of the present invention.

Referring now to FIG. 1, the combination chair/walker of the present invention is designated generally as 10. The chair/walker 10 aids in the independent mobility of elderly or disabled persons in standing, walking and sitting. Chair/walker 10 comprises an upper primary frame 12 having laterally spaced apart primary front legs 14 and primary rear legs 16 spaced rearwardly of primary front legs 14. The primary frame 12 is adjustably attached to a bottom frame 13 at the primary front legs 14 and rear legs 16. The bottom frame 13 has an auxiliary frame 18 that extends laterally outwardly from the primary front 14 and rear legs 16, and rearwardly of the primary rear legs 16. The auxiliary frame 18 has laterally spaced apart auxiliary front legs 20 and auxiliary rear legs 22 spaced rearwardly of the auxiliary front legs 20. In the preferred embodiment, the primary front legs 14 and the auxiliary rear legs 22 support the chair/walker 10 for movement over a floor in a stable upright position. In order to facilitate free and easy movement, rollers 24 may be provided, and optional roller locking means 26 may also be provided on one or more rollers 24. The auxiliary front legs 20 extend close to the floor but do not contact the floor when the chair/walker 10 is in a stable upright position to prevent a person from tipping the chair/walker 10. The primary rear legs 16 end at the bottom frame 13.

The chair/walker 10 further comprises means for sitting, the sitting means being supported from primary frame 12 at a predetermined sitting position, sitting means having a forward edge 30 spaced rearwardly of the primary front legs 14 and defining an open space extending rearwardly of primary front legs 14 for accommodating a person's legs while in a standing, walking and sitting position. It is to be understood that the sitting means 28 may comprise any suitable means, however, in the preferred embodiment this means comprises a seat 32 attached to a lateral bar 34 mounted on primary frame 12. As shown in FIG. 1, this lateral bar 34 is slidably mounted for sliding forward and rearward movement. In this manner, the seat 32 may be pushed into a fully rearward position for greater ease in walking (as shown in FIG. 1), or a fully forward position for comfortable sitting, or any intermediate position therebetween. It is to be further understood that the seat may be fixedly mounted upon primary frame 12.

The chair/walker further comprises means 36, disposed at a rearward portion of primary frame 12, for supporting a person's back area. This back support means 36 may comprise any suitable means, however, as shown in FIG. 1, this back support means 36 comprises a cylindrical bar extending laterally across the frame 12 and a flexible support netting 38 releasably secured at side vertical bars 40.

Chair/walker 10 further comprises means 42 attached to frame 12 for supporting at least one of a person's side and arms. This side and arm support means 42 may be used such that the person can lean against it for side support, the person may use it for an arm support, or the person may use it during walking for support and for guiding the chair/walker 10.

Further, the chair/walker 10 may be utilized to accommodate persons of varying heights and sizes, thereby lending great versatility to the present invention. It is to be understood that this chair/walker 10 may comprise any suitable frame 12, including any such suitable frame which may or may not be height adjustable. However, in the preferred embodiment, the primary frame 12 comprises four cylindrical legs 14 and 16, each slidably mounted at their lower ends to bottom frame 13. The selective positioning may be achieved by any suitable means, however, in the preferred embodiment it is achieved by a plurality of pin 44 and cable 46 combinations receivable within through bores 48, and a stop means 50 located on the primary front 14 and rear 16 legs where the upper primary frame 12 slidably attaches to bottom frame 13. Any number of positions may be achieved, but in the preferred embodiment at least three positions are possible. The pin 44 is received through bore 48 and secured in bore 48 by cable 46 which is removably attached to both ends of pin 44. In order to move to another position, cable 46 is removed from at least one end of pin 44 to allow pin 44 to be disengaged from through bore 48. This procedure is done for all primary legs 14 and 16. The primary frame 12 is then lifted or lowered to the desired position. Pins 44 are reinserted into through bore 48 and secured by cable 46. Repeat procedure for all primary legs 14 and 16.

Figure 2:
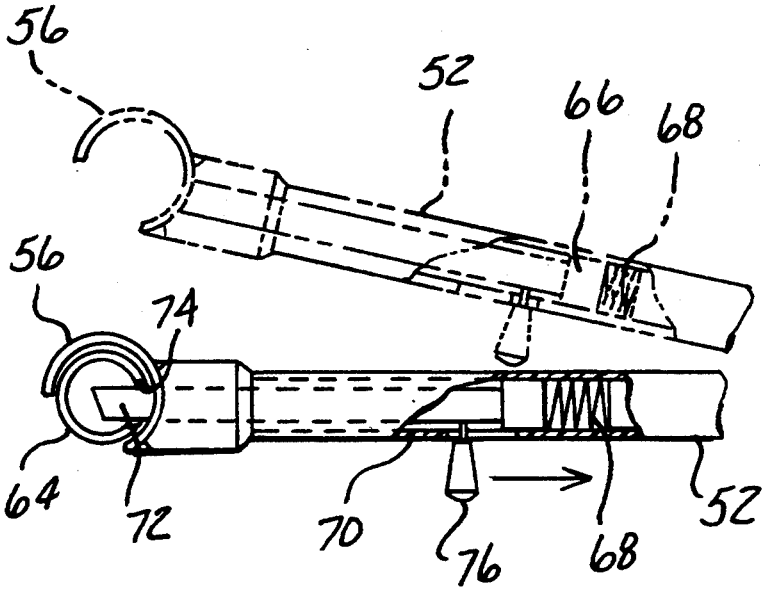
FIG. 2 is an enlarged side view of the frontal crossbar.

Chair/walker 10 may further comprise a frontal crossbar 52, attached to, and extending laterally between the side and arm support means 42, for supporting at least one of a person's front side and arm, and for guiding the chair/walker. In this way, a person can use bar 52 for frontal support and/or for arm support. Crossbar 52 has one end portion 54 pivotally connected to one side of the adjustable side and arm support means 42 for pivotal movement about a horizontal axis toward an open position extending upwardly when an opposite end portion 56 of crossbar 52 is disconnected from an opposite side of the adjustable side and arm support means. The closed position of crossbar 52 is shown in FIG. 2, and an open position is shown in phantom in FIG. 2. The opening of crossbar 52 permits ingress and egress of the person from a front side of chair/walker 10.

The chair/walker may further comprise means, cooperable with the opposite side 64 of the side and arm support means 42, for locking crossbar 52 against unwanted pivotal and vertical movement while in the closed position for providing a firm hand rail for guiding chair/walker 10 once secured to extend between the side and arm support means 42. This locking means may comprise any suitable means. However, in the preferred embodiment, this locking means comprises a manually slidable member 66 biased into a closed position as shown in solid line in FIG. 2, by a spring 68. Member 66 and spring 68 are operatively contained within hollow cylindrical sleeve 70. Projecting end 72, when in the locked position, is received within receiving bore 74 in the opposite side 64 of the side and arm support means 42. In order to unlock crossbar 52, knob 76 is pushed to the right as shown in FIG. 2, thereby retracting projecting end 72 out of bore 74, thereby allowing crossbar 52 to be moved pivotally upward and outward.

The present invention may further optionally comprise a crotch strap 58 attached to primary frame 12 and extending between a person's legs into the open space, strap 58 being releasably attachable to frontal crossbar 52 while in a closed position. Crotch strap 58 may be attached to the primary frame 12 in any suitable manner, however, in the preferred embodiment, one end of strap 58 is attached to a rear lateral bar of frame 12. The releasable attaching means may comprise any suitable means, however, in the preferred embodiment one end of the strap 58 is looped over bar 52, that one end having a female half of a quick release buckle attachment 62 and is releasably secured within a male half of the quick release buckle attachment 62 in a known manner.

Figure 3:
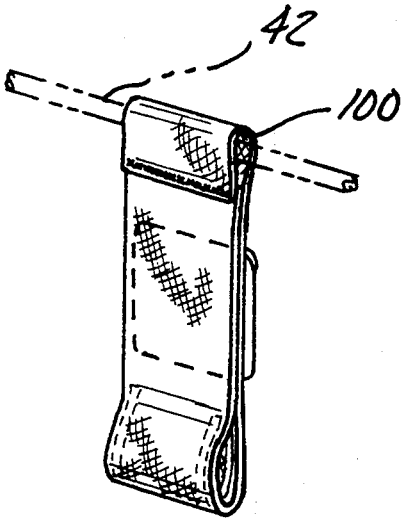
FIG. 3 is a perspective view of the tote means with the side and arm support means shown cutaway and in phantom.

A further optional component of the chair/walker is tote means 100 which is releasably attachable, as by Velcro, snaps or the like, to one of the side arms 42, as best seen in FIG. 3. The tote means may be of any suitable size and configuration to carry anything desired by the user. It is to be understood that any number of tote means may be used, and they may be attached in any suitable and appropriate area which would not interfere with ambulation.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A combination chair and walker for aiding the independent mobility of elderly or disabled persons in standing, walking and sitting, the chair/walker comprising:

an adjustable primary frame, comprising:

laterally spaced apart primary front legs; and primary rear legs spaced rearwardly of the primary front legs;

a bottom frame located proximate to a floor, comprising adjustable attachment means to the primary front and primary rear legs, and an auxiliary frame extending laterally from the primary front and primary rear legs and rearwardly from the primary rear legs, said auxiliary frame comprising:

laterally spaced apart front auxiliary legs; and
rear auxiliary legs spaced rearwardly of the front auxiliary legs;

the primary front and auxiliary rear legs supporting the chair/walker for movement over the floor in a stable, upright configuration;

means for sitting, the sitting means being supported from the primary frame at a predetermined sitting position, the sitting means having a forward edge spaced rearwardly of the primary front legs and defining an open space extending rearwardly of the primary front legs for accommodating a person's legs while in a standing, walking and sitting position, wherein the sitting means is selectively movable between a forward, sitting position, and a rear, walking position;

means, disposed at a rearward portion of the primary frame, for supporting a person's back area;

means for supporting at least one of a person's side and arms;

a frontal crossbar, attached to, and extending laterally between the side and arm support means, for supporting at least one of a person's front side and arms and for guiding the chair/walker, the crossbar having one end portion pivotally connected to one side of the side and arm support means for pivotal movement about a horizontal pivot axis toward an open position extending from the pivot axis when an opposite end portion of the crossbar is disconnected from an opposite side of the side and arm support means, to permit ingress and egress of the person from a front side of the chair/walker; and means, cooperable with the opposite side of the side and arm support means, for locking the crossbar against unwanted pivotal and vertical movement while in the closed position for providing a firm hand rail for guiding the chair/walker when secured to extend between the side and arm support means.

2. The chair/walker as defined in claim 1, wherein the adjustable primary frame comprises:

a through bore located on the primary front and primary rear legs where the adjustable primary frame slidably attaches to the bottom frame;

a pin having one end which is releasably receivable through a respective through bore; and a stop means, for preventing the primary frame from passing a lowermost position.

3. The chair/walker as defined in claim 2 wherein the pin and through bore allow at least two selectable positions.

4. The chair/walker as defined in claim 1, further comprising a crotch strap attached to the primary frame and extending between a person's legs into the open space, the strap being releasably attachable to the frontal crossbar while in a closed position.

5. The chair/walker as defined in claim 1, further comprising means, releasably attached to the frame, for toting articles.

6. A combination chair and walker for aiding the independent mobility of elderly or disabled persons in standing, walking and sitting, the chair/walker comprising:

an adjustable primary frame, comprising:
laterally spaced apart primary front legs; and
primary rear legs spaced rearwardly of the primary front legs;

a bottom frame located proximate to a floor, comprising adjustable attachment means to the primary front and primary rear legs, and an auxiliary frame extending laterally from the primary front and primary rear legs and rearwardly from the primary rear legs, said auxiliary frame comprising:
laterally spaced apart front auxiliary legs; and
rear auxiliary legs spaced rearwardly of the front auxiliary legs;

the primary front and auxiliary rear legs supporting the chair/walker for movement over the floor in a stable, upright configuration;

means for sitting, the sitting means being supported from the primary frame at a predetermined sitting position, the sitting means having a forward edge spaced rearwardly of the primary front legs and defining an open space extending rearwardly of the primary front legs for accommodating a person's legs while in a standing, walking and sitting position, wherein the sitting means is selectively movable between a forward, sitting position, a rear, walking position, and an intermediate position therebetween;

means, disposed at a rearward portion of the primary frame, for supporting a person's back area;

means for supporting at least one of a person's side and arms;

a frontal crossbar, attached to, and extending laterally between the side and arm support means, for supporting at least one of a person's front side and arms and for guiding the chair/walker, the crossbar having one end portion pivotally connected to one side of the side and arm support means for pivotal movement about a horizontal pivot axis toward an open position extending from the pivot axis when an opposite end portion of the crossbar is disconnected from an opposite side of the side and arm support means, to permit ingress and egress of the person from a front side of the chair/walker; and means, cooperable with the opposite side of the side and arm support means, for locking the crossbar against unwanted pivotal and vertical movement while in the closed position for providing a firm hand rail for guiding the chair/walker when secured to extend between the side and arm support means.

7. A combination chair and walker for aiding the independent mobility of elderly or disabled persons in standing, walking and sitting, the chair/walker comprising;

an adjustable primary frame, comprising:
laterally spaced apart primary front legs; and
primary rear legs spaced rearwardly of the primary front legs;

a bottom frame located proximate to a floor, comprising adjustable attachment means to the primary front and primary rear legs, and an auxiliary frame extending laterally from the primary front and primary rear legs and rearwardly from the primary rear legs, said auxiliary frame comprising:
laterally spaced apart front auxiliary legs; and
rear auxiliary legs spaced rearwardly of the front auxiliary legs;

the primary front and auxiliary rear legs supporting the chair/walker for movement over the floor in a stable, upright configuration;

means for sitting, the sitting means being supported from the primary frame at a predetermined sitting position, the sitting means having a forward edge spaced rearwardly of the primary front legs and defining an open space extending rearwardly of the primary front legs for accommodating a person's legs while in a standing, walking and sitting position;

means, disposed at a rearward portion of the primary frame, for supporting a person's back area;

means for supporting at least one of a person's side and arms;

a frontal crossbar, attached to, and extending laterally between the side and arm support means, for supporting at least one of a person's front side and arms and for guiding the chair/walker, the crossbar having one end portion pivotally connected to one side of the side and arm support means for pivotal movement about a horizontal pivot axis toward an open position extending from the pviot axis when an opposite end portion of the crossbar is disconnected from an opposite side of the side and arm support means, to permit ingress and egress of the person from a front side of the chair/walker; and means, cooperable with the opposite side of the side and arm support means, for locking the crossbar against unwanted pivotal and vertical movement while in the closed position for providing a firm hand rail for guiding the chair/walker when secured to extend between the side and arm support means; and a plurality of rollers at floor contacting ends of the primary front and auxiliary rear legs.

8. The chair/walker as defined in claim 7, wherein the auxiliary front legs extend close to the floor, and the primary rear legs end at the bottom frame.

9. A combination chair and walker for aiding the independent mobility of elderly or disabled persons in standing, walking and sitting, the chair/walker comprising:

an adjustable primary frame, comprising:

laterally spaced apart primary front legs; and primary rear legs spaced rearwardly of the primary front legs;

a bottom frame located proximate to a floor, comprising adjustable attachment means to the primary front and primary rear legs, and an auxiliary frame extending laterally from the primary front and primary rear legs and rearwardly from the primary rear legs, said auxiliary frame comprising:

laterally spaced apart front auxiliary legs; and rear auxiliary legs spaced rearwardly of the front auxiliary legs;

the primary front and auxiliary rear legs supporting the chair/walker for movement over the floor in a stable, upright configuration;

means for sitting, the sitting means being supported from the primary frame at a predetermined sitting position, the sitting means having a forward edge spaced rearwardly of the primary front legs and defining an open space extending rearwardly of the primary front legs for accommodating a person's legs while in a standing, walking and sitting position, wherein the sitting means is selectively movable between a forward, sitting position, and a rear, walking position;

means, disposed at a rearward portion of the primary frame, for supporting a person's back area;

means for supporting at least one of a person's side and arms; and a plurality of rollers at floor contacting ends of the primary front and auxiliary rear legs.

10. The chair/walker as defined in claim 9, wherein the sitting means is further selectively movable to an intermediate position between the forward, sitting position, and the rear, walking position.

11. The chair/walker as defined in claim 9, wherein the auxiliary front legs extend close to the floor, and the primary rear legs end at the bottom frame.

* * * * *

UNITED STATES PATENT AND TRADEMARK OFFICE

CERTIFICATE OF CORRECTION

PATENT NO. : 5,427,438

DATED : June 27, 1995

INVENTOR(S) : Arthur J. Fochs

It is certified that error appears in the above-indentified patent and that said Letters Patent is hereby corrected as shown below:

Column 7, line 20, delete "pviot" and insert

--pivot--.

Signed and Sealed this

Third Day of October, 1995

*Attest:*

BRUCE LEHMAN

*Attesting Officer*

*Commissioner of Patents and Trademarks*